United States Patent [19]

Tyree, Jr.

[11] 4,350,027

[45] Sep. 21, 1982

[54] CRYOGENIC REFRIGERATION APPARATUS

[76] Inventor: Lewis Tyree, Jr., 145 Briarwood Ave., North, Oak Brook, Ill. 60521

[21] Appl. No.: 308,373

[22] Filed: Oct. 5, 1981

[51] Int. Cl.[3] ..... F25D 17/02

[52] U.S. Cl. ..... 62/374; 62/380

[58] Field of Search ..... 62/63, 374, 380, 384

[56] References Cited

U.S. PATENT DOCUMENTS

| | | | |
|---|---|---|---|
| 3,063,258 | 11/1962 | Szachnitowski | 62/309 |
| 3,402,568 | 9/1968 | Kamin et al. | 62/380 |
| 3,427,820 | 2/1969 | Hart | 62/380 |
| 3,512,370 | 5/1970 | Murphy et al. | 62/380 |
| 3,871,185 | 3/1975 | Harper et al. | 62/380 |
| 4,058,384 | 11/1977 | Keefe | 62/457 |
| 4,229,947 | 10/1980 | Klee | 62/380 |

*Primary Examiner*—Ronald C. Capossela
*Attorney, Agent, or Firm*—Fitch, Even, Tabin, Flannery & Welsh

[57] ABSTRACT

An endless conveyor carries articles being cooled through a freezing tunnel. Spray nozzles at longitudinally spaced locations along the tunnel expand high pressure liquid nitrogen to substantially atmospheric pressure to create a central flow of cold fluid in association with a surrounding inducer. The nozzles are arranged in an array with a first group being directed downward and toward the entrance and with a second group being directed downward and toward the exit end. A fan disposed in the intermediate region between the two groups creates an upward flow of cryogen vapor into the region that maintains a head of higher pressure vapor at the entrance to each of the inducers. Downwardly directed blowers are located between the array and both the entrance and exit ends in order to assure there is efficient extraction of heat from articles being carried along the conveyor from end to end. The inducers create an efficient circulation of vapor in the enclosure, and the rate of flow of cryogen being expanded is regulated by using nozzles having changeable orifice areas.

10 Claims, 4 Drawing Figures

LN2

CRYOGENIC REFRIGERATION APPARATUS

This invention relates to cryogenic cooling of material being moved through an insulated enclosure, and more specifically to the cooling or freezing of articles by a cryogen, such as liquid nitrogen, while the articles are carried through an insulated tunnel on an endless conveyor or the like.

BACKGROUND OF THE INVENTION

Cryogenic freezing and/or cooling of material, including food products, pharmaceuticals and the like, has become a commercial reality over the past decade and is in widespread use throughout the industrialized world. One piece of apparatus often employed in such cryogenic cooling is an elongated enclosure or tunnel through which the material is passed on an endless conveyor belt. The cryogen, such as liquid nitrogen, is injected into the tunnel and caused to undergo heat-exchange with the material carried on the conveyor resulting in the lowering of the temperature of the material to the desired level. Improvements in cooling and/or freezing systems of this general type have been constantly sought after.

SUMMARY OF THE INVENTION

The invention provides a freezing tunnel through which an endless conveyor carries articles being cooled. Spray nozzles in association with a surrounding inducer are located at longitudinally spaced locations along the tunnel and expand a liquid cryogen to substantially atmospheric pressure to create a spray of cold fluid together with enhanced vapor movement. Some additional spray nozzles can be utilized without the surrounding inducers if desired. The nozzles are arranged in an array with a first group being directed downward and toward the tunnel entrance and with a second group being directed downward and toward the exit end. A fan disposed in the intermediate region between the two groups creates an upward flow of cryogen vapor into the region that maintains a head of higher pressure vapor at the entrance to each of the inducers. Downwardly directed blowers are located between the array and both the entrance and exit ends in order to assure there is efficient extraction of heat from articles being carried along the conveyor from end to end.

DETAILED DESCRIPTION OF THE PREFERRED EMBODIMENTS

Figures 1, 2, 3, 4:
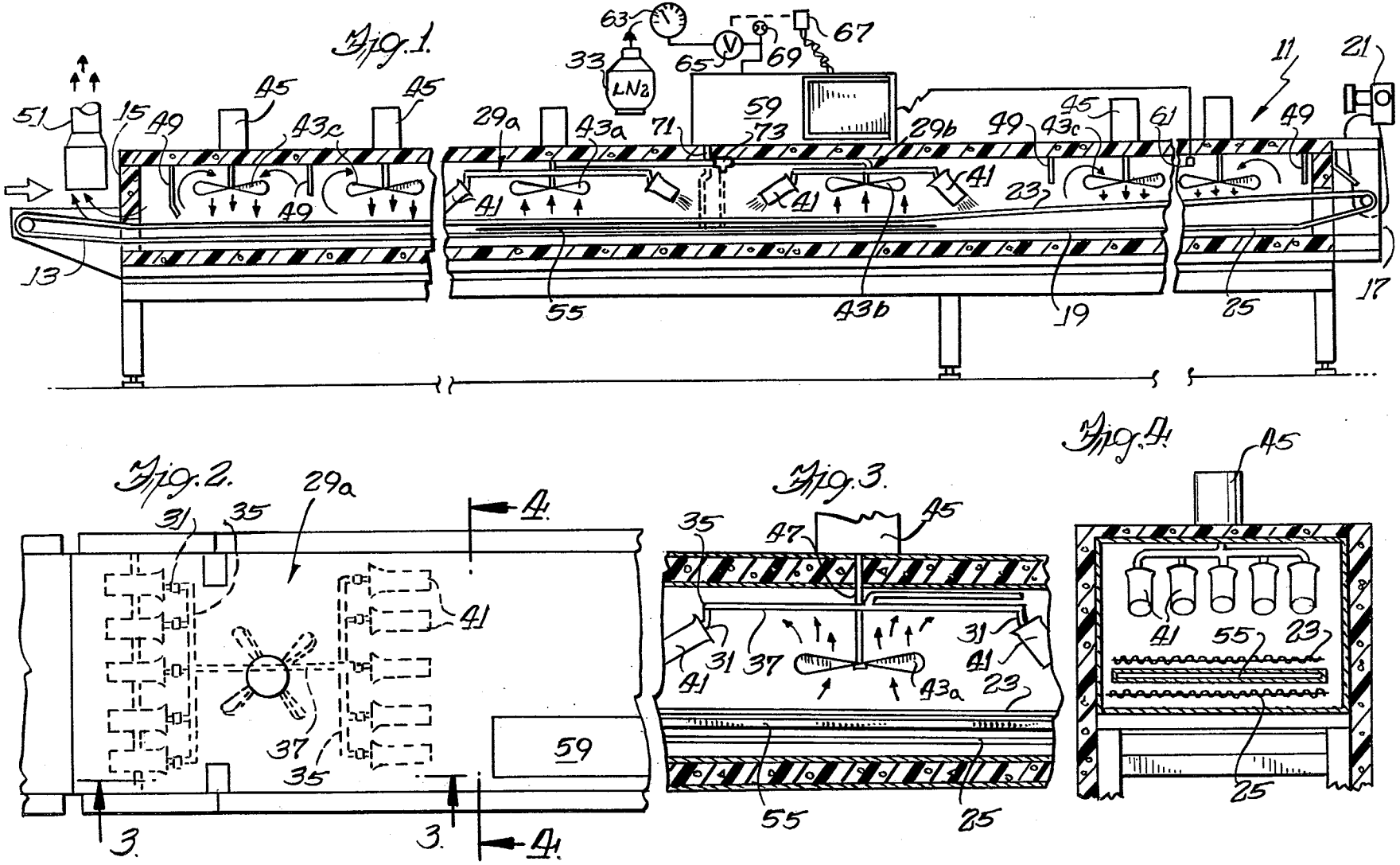
FIG. 1 is a front sectional view of a cryogenic freezing tunnel embodying various features of the invention.
FIG. 2 is a fragmentary plan view, enlarged in size, of the apparatus of FIG. 1.
FIG. 3 is a fragmentary sectional view taken generally along the line 3—3 of FIG. 2.
FIG. 4 is a sectional view taken along the line 4—4 of FIG. 2.

Shown in FIG. 1 is an insulated elongated enclosure or tunnel 11 through which material (not shown) to be cooled or frozen is transported on an endless conveyor 13 from an entrance end 15 to an exit end 17. The articles to be frozen, for example, pizzas, are placed on the endless conveyor 13 at the entrance end and removed at the exit end by apparatus (not shown) of a type well known in the art which forms no part of the present invention. The conveyor 13 may include an endless wire open mesh belt 19 made of a suitable material for use with food products, e.g., stainless steel, and it is driven in the customary manner by a drive arrangement 21 which permits the speed of the belt to be regulated as desired. The upper run 23 of the belt in FIG. 1 moves from left to right, and a lower or return run 25 moves from right to left.

Two arrays 29*a* and *b* of cryogen injection devices 31 are located generally centrally of the tunnel. Both of the arrays 29 are essentially duplicates of each other, and accordingly only the left-hand array 29*a* which is located on the entrance side of the longitudinal center point of the tunnel 11 will be described. The precise longitudingal positioning of the arrays 29 is not critical, and some shifting toward the entrance or toward the exit end of the tunnel could be effected, if desired, for a particular product to be cooled although the central location illustrated is preferred.

As best seen in FIGS. 2 and 4, each array 29 includes a group of cryogen injection devices 31 that is directed upstream (or towards the entrance end) and a group that is directed downstream (or towards the exit end), and each array is connected to a source 33 of high-pressure liquid cryogen, preferably nitrogen, through an appropriate piping network. Connection to each device 31 in an array is made by a pair of headers 35 which are interconnected by a cross-pipe 37 that is joined to a liquid nitrogen supply network described hereinafter. Each of the injection devices 31 includes a nozzle, which is preferably spring-loaded to the closed position and includes a movable plug that produces a changing orifice area either relative to the fluid pressure in the cryogen header 35 or relative to a fluid counter-pressure used for control purposes. It may be similar to the devices disclosed in U.S. Pat. No. 3,815,377, issued June 11, 1974, the disclosure of which is incorporated herein by reference.

Each of the nozzles discharges at a location within a surrounding inducer 41 which preferably has a flared upper entrance and which amplifies the circulation of vapor within the freezer resulting both from the direct expansion of that portion of the high-pressure fluid naturally flashing to vapor at substantially atmospheric pressure and the subsequent expansion of the portion of entrained liquid in the high pressure fluid stream. This secondary circulation effect which is created by the inducers 41 creates a suction adjacent the entrance to the inducers and magnifies the amount of vapor that is discharged from the injection devices 31 over what would occur simply as a result of expansion through the nozzle. Moreover, the secondary circulation effect is further amplified by creating a high-pressure region adjacent the entrance to the inducers 41 by means of a fan 43*a* which is located intermediate the two groups of injection devices 31 and which is powered by an electric motor 45 located above the insulated tunnel and driven by a shaft 47 which extends through the top wall of the tunnel. A similar fan 43*b* is associated with the other array 29*b*.

For a tunnel 11 which is, for example, about 40 inches wide, each group of injection devices 31 may include five evenly spaced devices facing upstream attached to one header 35 and another five devices facing downstream attached to another header 35, as best seen in FIG. 2. Depending upon width constraints or other considerations, some injection devices 31 may be included without a surrounding inducer; however, a major portion would have inducers. By driving the fan 43*a* that is pitched so as to create an upward vapor circulation, a dynamic high-pressure region is created in the vicinity of the entrances to the ten inducers 41 in the array 29*a* which has a supercharging effect thereupon. In general, the action of the nozzle within each of the inducers 41 is similar to that of a jet pump and causes a substantial volume of gas to be sucked into the entrance and discharged at a high velocity along with the vapor exiting from at the orifice that is formed by the expanding cryogen. The creation of the dynamic high-pressure region adjacent the entrance to each of the inducers 41, that results from the upwardly directed fan 43*a*, assures the passage of vapor through the inducers at an even higher mass flow rate and thus adds to the overall efficiency of the unit. Another important result is that more of a mist than a spray is created, and this high pressure mist can be used to improve the freezing capability.

Because the nitrogen vapor being created is at a temperature very substantially below the freezing point of water, i.e., 32° F., the vapor is effectively employed between the entrance and exit ends to extract heat from the products being frozen. To assure that the desired heat transfer occurs at a relatively high rate while the articles are being moved through the tunnel 11 by the continuously moving conveyor 13, a plurality of downwardly directed fans 43*c* are provided at spaced locations along the length of the tunnel. Each of these fans is also driven by an electric motor 45 via a shaft which extends through the upper insulated wall of the tunnel, and the fans are provided with associated baffling 49 which assists in creating the desired flow patterns generally downward onto the upper surfaces of the articles being carried along the belt 19. In very long freezers, some additional, upwardly directed fans 43 may be used to eliminate the creation of a region of high negative pressure that could result in localized inward air leakage. So as to remove the cold vapor from the vicinity of the exit and entrance ends of the tunnels, the ends are well baffled and a vent blower 51 is preferably provided adjacent the entrance end which is suitably adjusted, as is known in the art, so as to remove, for example, about 90% of the vapor through the entrance end 15 and restrain all but about 10% of the vapor from discharging through the exit end 17, thereby maintaining a positive heat at both ends which prevents any significant intrusion of humidity-bearing ambient air.

The stainless steel or other metallic material in the endless conveyor belt 19 will, of course, extract some heat by conduction from the underside of the articles being cooled or frozen as they travel the length of the tunnel. In addition, heat will be extracted by convection with the vapor within the tunnel which is kept moving as a result of the location of the fans 43, baffles 49, and the nozzle-inducer combinations 31, 41. However, although high-velocity vapor will come in contact with the upper surfaces of the articles, the vapor which contacts the undersides will be of a somewhat lower velocity, and thus additional extraction of heat from the underside of the articles is desirable and is preferably achieved by the optional provision of a longitudinally extending, hollow heat-exchange plate 55. In the illustrated embodiment shown in FIG. 1, the heat-exchange plate 55 is of a length about equal to the length of the central region wherein the two arrays 29 of cryogen injection devices 31 are located. The width of the plate is approximately equal to the width of the conveyor belt, and the fans 43*a* which suck vapor upwardly so as to supercharge the inducers can pull cold vapor from the lower portion of the tunnel upwardly about the lateral edges of the heat-exchange plate 55. This plate also serves the additional function of collecting any liquid $N_2$ resulting from any overspray from the nozzles 31.

The heat-exchange plate 55 is located just below the undersurface of the top run 23 of the endless conveyor belt and has its upper surface designed to function as a cold-body radiator by forming it of a material such as stainless steel. The heat-exchange plate 55 is hollow, and its temperature is maintained at about −300° F. by feeding liquid nitrogen therethrough at a pressure of about 50 psia, for example. The temperature and pressure of the nitrogen will vary somewhat as explained hereinafter. A certain amount of heat radiates from the articles being carried along the conveyor that are being cooled or frozen, and this heat of radiation is absorbed by the heat-exchange plate surface and transferred to the nitrogen fluid within the plate. Inasmuch as the pressure of the nitrogen within the plate is maintained substantially constant, the absorption of heat causes a change in the quality of the fluid, increasing the vapor fraction, which constitutes a further advantage as indicated hereinafter. Any liquid nitrogen overspray will tend to be colder, e.g. about −320° F., because the freezer interior will be close to 15 psia, and will be vaporized on the plate by the radiation heat transfer.

Overall control of the operation of the apparatus is carried out by a control system 59 which may be conveniently located thereatop the central portion of the tunnel 11. The temperature within the insulated tunnel is detected by one or more temperature sensors, such as the sensor 61 located near the exit end, which is monitored by the control system. The cryogen injected into the tunnel 11 is obtained from a suitable source, such as a liquid nitrogen tank 33 that is typically at about 50 psia as a result of natural heat leaks, and the tank pressure may be read via a suitable gauge 63 disposed in the supply line. In the event, tank pressure becomes too low, an automatic vaporizer (not shown) maintains a minimum desired pressure, as is well known in the art. A modulating pressure-reducing valve 65 is located downstream of the supply line gauge 63 and is operated by a controller 67 which receives its signal from the main control system. A second gauge 69 may be provided in the line leading downstream from the modulating valve 65 so as to read the fluid pressure in a line 71 leading into the tunnel. Prior to reaching the supply network leading to the headers 35 that feed the two arrays of cryogen injection devices, the liquid nitrogen flows into and through the hollow heat-exchange plate 55 where it absorbs some heat radiating from the underside of the articles being cooled and changes quality, increasing in its vapor content. The liquid nitrogen (which may contain a significant vapor fraction) exiting from the hollow plate 55 travels upward and through a tee 73 into the supply network leading to the headers 35 that serve the individual injection devices 31. Fluid flow principles may be used to cause certain injectors to preferentially receive liquid nitrogen having a higher fraction of gaseous nitrogen.

As earlier indicated, each of the devices has a nozzle orifice which is biased to a normally closed position, and when liquid nitrogen is employed as the cryogen, the spring pressure may be set so as to close the orifice at about 30 psia. Accordingly, when the modulating valve 65 opens so as to apply $N_2$ pressure above this lower limit to the heat-exchange plate and in turn to the headers, the individual nozzles will open beginning injection of nitrogen vapor into the tunnel. In this respect, the injection devices 31 are constructed so as to gradually enlarge the orifice area as the pressure increases that is supplied to the devices by the modulating valve and thereby permit substantial increases in the rate of nitrogen being injected, as regulated by the control system 59 by control of the modulating valve 65. Depending upon the pressure and flow rate of cryogen, all of it may vaporize at the nozzle or there may be small drops of liquid dispersed or entrained as a mist in the vapor stream leaving the devices 31.

Although all of the spring-loaded cryogen injection devices 31 might be designed to operate simultaneously at all times, in one preferred arrangement, the injection devices in the left-hand array 29*a* are set to open at a slightly higher pressure than the nozzles in the right-hand array 29*b*, e.g., about 40 psia vs. 30 psia (with $N_2$ as the cryogen). Accordingly, when the control system 59 signals the controller 67 to open the pressure-reducing valve 65 to establish a pressure within the range between those two pressures, cryogen will be injected only from the right-hand array 29*b* of nozzles, thus providing a longer pre-cooling section of the tunnel before the colder, cryogen-injection region is reached. This arrangement gives the apparatus somewhat more flexibility for, if the supply of articles to be cooled or frozen slows down, the control system 59 can detect a subsequent lowering of the temperature in the tunnel and react accordingly by lowering the cryogen supply pressure to a value wherein only the right-hand array 29*b* of injection devices will be operating until such time as the load on the apparatus again increases. Other arrangements may also be used, such as intermixing the devices set to open at different pressures, or having devices with inducers open at the lower pressure and devices without inducers open at the higher pressure.

Normally during operation, all of the fans 43 will be operated at constant speed; however, if desired, variable speed motors could be employed, with control of the electric power to the individual motors being effected by the control system 59 in response to the temperature sensed within the tunnel or some other input. The upwardly directed fans 43*a* and *b* assure there is a high-pressure heat at the flared entrances to the inducers 41, and the jet-pump-like action of the inducers begins as soon as the nozzles open and expansion of nitrogen begins. Thus, a very significant circulation of very cold nitrogen vapor exits from the discharge end of the inducers, and the total flow rate substantially exceeds the rate at which nitrogen is being expanded through the orifice. This is a result of the secondary flow of additional vapor being carried through the inducers which secondary flow is further amplified by the high-pressure head at the entrance that is created by the upwardly directed fans 43*a* and *b*. The added vapor content of the nitrogen stream exiting from the heat-exchange plate 55 is further helpful in increasing the secondary flow as it exits from the nozzle orifices, and this adds to the efficiency of the total circulation created by the injection devices 31. Heat leaks into the piping system between the tank and the tunnel also contribute to the vapor content of the nitrogen stream and thus add to the inducing effect.

The combination of the modulating valve 65 and the control system 59 provides an extremely efficient way of maintaining the temperature within the tunnel within a relatively precise range, and the overall operation proves to be extremely efficient in BTUs removed from food products being frozen versus pounds of liquid nitrogen expanded. Moreover, the apparatus is commercially attractive because it is energy-efficient in obtaining very substantial amounts of vapor circulation within the tunnel from the nozzle-inducer combinations, which not only obviates the need for electrical power in driving additional fans to otherwise achieve the circulation, but it avoids the heat burden otherwise associated with such fan that must be compensated for in order to maintain freezing temperatures within the tunnel. Effective removal of heat from the underside of the articles being frozen by conduction, convection, and radiation (that is in part due to the presence of the hollow heat-exchange plate 55) contributes substantially to the ability to achieve thorough freezing with a reasonable tunnel length.

Although the terms "freezer" and "freezing" have been generally used throughout, it should be understood that the apparatus is also effective in cooling material to temperatures above the freezing point of water, i.e., 32° F., and can be employed merely for cooling or chilling instead of freezing. Likewise, although the largest commercial opportunity for the apparatus appears to be in the freezing or cooling of food products, pharmaceuticals and other non-food products may also be effectively cooled and/or frozen so long as they are capable of transportation through a tunnel on a conveyor.

Although the invention has been described with regard to certain preferred embodiments, various changes and modifications as would be obvious to one having the ordinary skill in the art may be made without departing from the scope of the invention which is set forth in the appended claims. Particular features of the invention are emphasized in the claims which follow.

What is claimed is:

1. Refrigeration apparatus for utilizing a cryogenic liquid, such as liquid nitrogen, to cool material which is moved therethrough, which apparatus comprises:

means defining an elongated insulated enclosure, means for conveying material to be cooled through said enclosure from an entry end to an exit end thereof, cryogen injection devices located above said conveying means for expanding cryogen under superatmospheric pressure to substantially atmospheric pressure, which include spray nozzle means and a major portion of which include inducer means located in surrounding relationship to said spray nozzle means, said devices being arranged in a first array with a first group of nozzle means being directed downward and toward said entrance end and with a second group of nozzle means being directed downward and toward said exit end, said first and second groups being spaced longitudinally apart to provide an intermediate region therebetween, fan means located between said first and second groups for creating an upward flow of cryogen vapor in said intermediate region and means for supplying liquid cryogen under superatmospheric pressure to said devices.

2. Refrigeration apparatus in accordance with claim 1 wherein downwardly directed fan means is disposed between said entrance end and said array and between said exit end and said array.

3. Refrigeration apparatus in accordance with claim 1 wherein said nozzle means are spring-loaded to a closed position so as to open only when the cryogen being supplied thereto is at or above a first predetermined pressure.

4. Refrigeration apparatus in accordance with claim 3 wherein a second array of groups of injection devices, plus associated upwardly directed fan means in an intermediate region, is located in said enclosure at a position upstream of said first array, and wherein said nozzle means in said second array are spring-loaded so as to open only at a pressure of supplied liquid cryogen substantially above said first predetermined pressure.

5. Refrigeration apparatus in accordance with claim 4 wherein means is provided for sensing the temperature at a desired location within said enclosure, and control means is provided, which is connected to said temperature sensing means and to said cryogenic liquid supply means, for changing the pressure of cryogenic liquid being supplied to said nozzle means proportional to the temperature sensed.

6. Refrigeration apparatus in accordance with claim 5 wherein control means operates said downwardly directed fan means and said intermediate region fan means regardless of the amount of flow of liquid cryogen through said nozzle means.

7. Refrigeration apparatus in accordance with claim 5 wherein said nozzle means have orifice areas that enlarge as said pressure of cryogenic liquid increases so as to significantly vary the rate of expansion of cryogen.

8. Refrigeration apparatus in accordance with claim 1 wherein said conveying means includes an endless belt, wherein heat-exchange plate means is provided in said enclosure at a longitudinal location about that of said first array and disposed vertically below an upper run of said endless conveyor belt and above a return run thereof, wherein liquid cryogen being supplied to said devices is caused to flow through said heat-exchange plate means, and wherein said heat-exchange plate means is fabricated to function as a cold body radiator and facilitate radiation heat transfer between the undersurface of the material being carried on said endless conveyor belt and the upper surface of said hollow heat-exchange plate.

9. Refrigeration apparatus in accordance with claim 8 wherein said means for supplying liquid cryogen includes a liquid nitrogen storage tank and means for reducing the pressure of said liquid nitrogen below the available tank pressure and wherein said heat-exchange plate means is hollow and is disposed downstream of said pressure-lowering means so that the radiation transfer of heat from the material on said belt changes the quality of the nitrogen being supplied to said nozzles by increasing the vapor content thereof.

10. Refrigeration apparatus for utilizing a cryogen liquid, such as liquid nitrogen, to cool material, which apparatus comprises:

means defining an elongated insulated enclosure, means for conveying material to be cooled through said enclosure from an entry end to an exit end thereof, cryogen injection devices located above said conveying means for expanding cryogen under superatmospheric pressure to substantially atmospheric pressure to create cold vapor, which include nozzle means and a major portion of which include inducer means located in surrounding relationship to said nozzle means, said devices having a variable orifice area so as to vary the rate of expansion of cryogen therethrough, means for supplying liquid cryogen under superatmospheric pressure to said devices, and means for varying the orifice areas of said devices so as to regulate the cryogen circulation within said enclosure which results from the effect of said surrounding inducers.

* * * * *

UNITED STATES PATENT AND TRADEMARK OFFICE

CERTIFICATE OF CORRECTION

PATENT NO. : 4,350,027

DATED : September 21, 1982

INVENTOR(S) : Lewis Tyree, Jr.

It is certified that error appears in the above—identified patent and that said Letters Patent is hereby corrected as shown below:

Column 2, line 16, correct the spelling of "longitudinal".

Column 3, line 47, change "heat" to --head--.

Column 5, line 47, change "heat" to --head--.

Signed and Sealed this

Seventh Day of December 1982

[SEAL]

*Attest:*

GERALD J. MOSSINGHOFF

*Attesting Officer*

*Commissioner of Patents and Trademarks*